United States Patent [19]

Bungener

[11] Patent Number: 4,530,607

[45] Date of Patent: Jul. 23, 1985

[54] ALARM AND RESET CIRCUIT FOR A COUNTDOWN TIMER

[75] Inventor: John H. Bungener, Glenview, Ill.

[73] Assignee: Pelouze Scale Company, Evanston, Ill.

[21] Appl. No.: 639,505

[22] Filed: Aug. 10, 1984

[51] Int. Cl.[3] ..... G04F 8/00

[52] U.S. Cl. ..... 368/109; 368/250; 368/254

[58] Field of Search ..... 368/107–110, 368/112, 250, 254, 89

[56] References Cited

U.S. PATENT DOCUMENTS 2,799,847 7/1957 Harris ..... 368/109

3,187,319 6/1965 Crawford ..... 368/108

*Primary Examiner*—Bernard Roskoski

*Attorney, Agent, or Firm*—A. G. Douvas

[57] ABSTRACT

A battery-powered alarm and reset circuit for a conventional electromechanical countdown timing mechanism which drives a set of cam-actuated main contacts. The circuit renders both a visual and an audible alarm at zero countdown time. The rotation of a timer knob closes the main contacts which readies the digital NAND gate logic of the circuit to a state preliminary to oscillation. At zero countdown time, one of the NAND gates goes into oscillation to generate a sequence of relatively low-frequency pulses in response to the opening of the main contact at zero countdown time. The low-frequency pulses activate an LED light to render a visual blinking alarm and an electrical horn to render an audible beeping alarm. Both alarms continue indefinitely until momentary manual closure of a reset switch stops the NAND gate from oscillating.

7 Claims, 6 Drawing Figures

| INPUT | INPUT | OUTPUT |
|---|---|---|
| 1 | 1 | 0 |
| 1 | 0 | 1 |
| 0 | 1 | 1 |
| 0 | 0 | 1 |

ALARM AND RESET CIRCUIT FOR A COUNTDOWN TIMER

BACKGROUND OF THE INVENTION

This invention relates to an alarm and reset circuit for a countdown timer. Electromechanical timers particularly adapted to time cooking operations have been used extensively in recent years. In many instances, these devices have failed to give an adequate alarm that a zero countdown time has been attained which indicates that a particular step in a cooking procedure has been completed.

The timers which have rendered satisfactory alarms are generally too costly to have attained widespread usage because of their structural complexity. Additionally, in many instances these complex timing devices have required more manipulative steps to operate than was convenient.

SUMMARY OF THE INVENTION

Accordingly, a principal object of this invention is the attainment of a simple, inexpensive and effective alarm circuit for a countdown timer which renders both a visual and an audible alarm at zero countdown time and which alarms can be ceased by the momentary manual operation of a reset or off switch.

The novel circuitry of this invention may be used with an inexpensive spring-driven mechanical timer whose selectable countdown time is typically determined by manual rotation of a pointer knob associated with a circular time scale. The rotation of the knob closes a main timing switch of the circuitry which readies the digital NAND gate logic of the circuit to a state preliminary to oscillation. At zero countdown time, one of the NAND gates of the circuit goes into oscillation to generate a sequence of relatively low-frequency pulses in response to the opening of the main timing switch at zero countdown time. The low-frequency pulses activate an LED light to render a visual blinking alarm and an electrical horn or buzzer to render an audible beeping alarm.

Both alarms continue indefinitely until a momentary manual closure of a reset or off switch stops the NAND gate from oscillating.

Because of the novel circuitry of this invention, the operation of the reset switch not only terminates the alarm function, but also places the circuitry in readiness for a succeeding countdown timing procedure without the intervening operation of an on-off power switch. Battery voltage is continuously applied to the alarm circuitry. However, because all gates have a high impedance input during standby conditions and the transistor amplifier driving the LED and horn alarms is biased to cut-off, the alarm circuit uses an insignificant current drain during standby. This condition eliminates the need for an on-off swirch which would otherwise complicate the operation of the timer.

BRIEF DESCRIPTION OF THE DRAWINGS

In order that all of the structural features for attaining the objects of this invention may be readily understood reference is herein made to the accompanying drawings wherein.

DETAILED DESCRIPTION OF THE INVENTION

Figure 1:
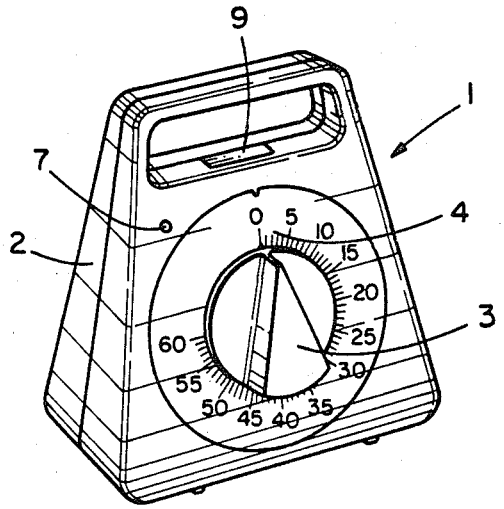
FIG. 1 is a perspective view of a typical countdown timer with which the alarm and reset circuit of this invention may be used.
Figure 2:
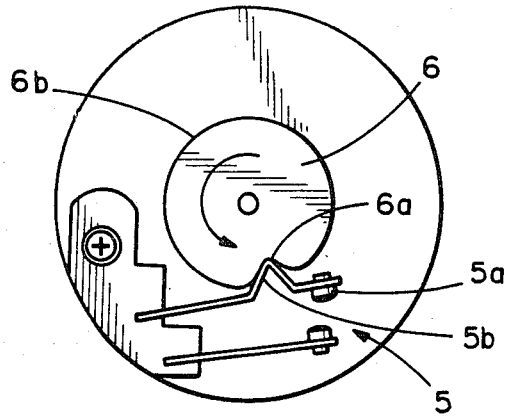
FIG. 2 is a fragnentary view showing a set of cam-actuated timer switch contacts in the timer "off" or open position, corresponding to zero countdown time, during which the alarm circuitry is activated until the reset switch is momentarily manually closed.
Figure 3:
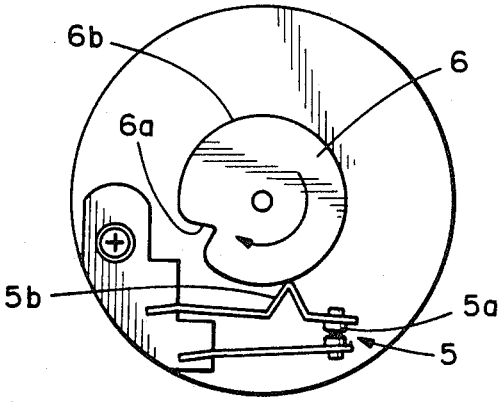
FIG. 3 is a fragmentary view related to FIG. 2 but showing the switch contacts in the timer "on" or closed position during timing countdown prior to the attainment of zero time.
Figure 4:
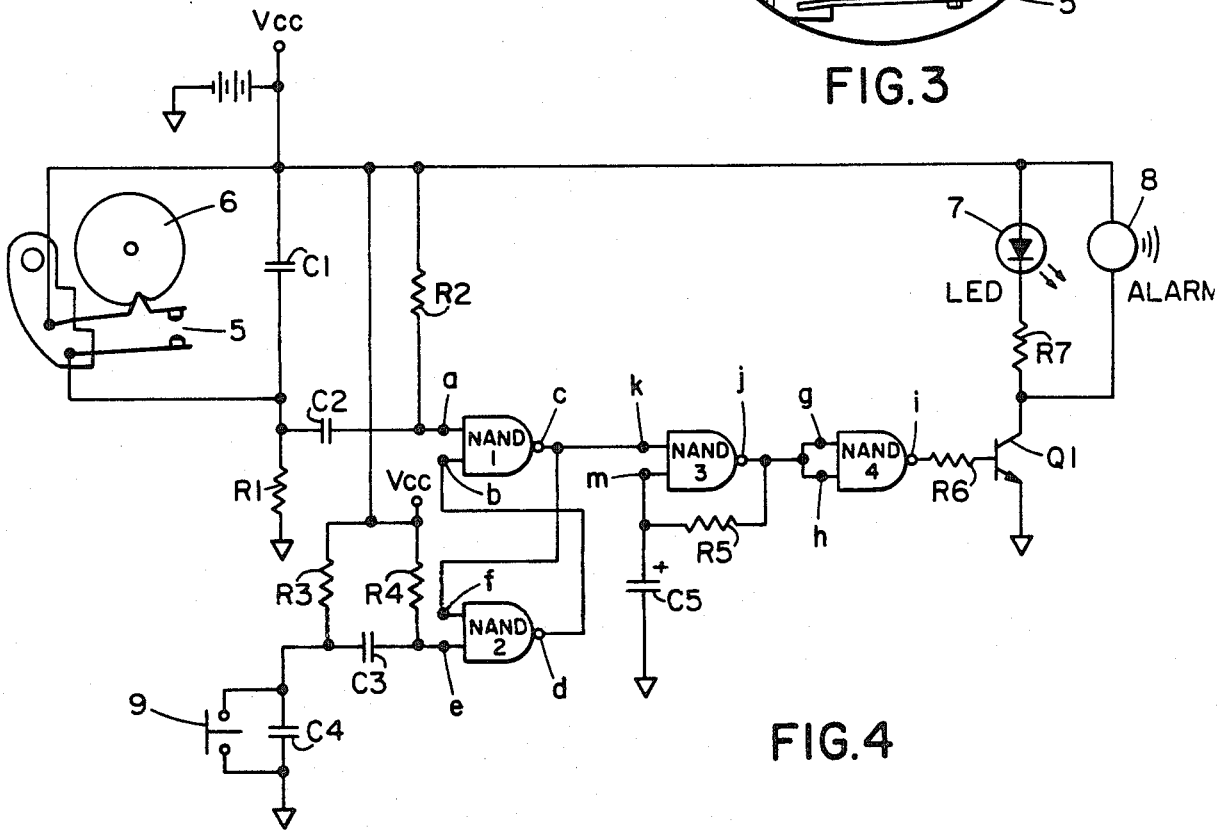
FIG. 4 is a schematic circuit diagram of a preferred embodiment of the alarm and reset circuit of this invention.

Referring to FIGS. 1–3 of the drawings, FIG. 1 shows a countdown timer 1 of the type which may incorporate the alarm and reset circuitry of this invention (shown in FIG. 4). Timer 1 may typically be contained within a plastic housing 2. Various countdown times, for example, from 60 minutes to zero time are determined by rotating knob 3 clockwise until the point of the knob is located at the desired time on circular time scale 4 from which the countdown is to begin.

A conventional electromechanical timer mechanism (not shown) is located within the housing. This timer includes a set of cam-actuated main contacts 5 (FIGS. 2 and 3) in which the leaf spring of the upper contact 5*a* rides or follows the surface of rotatable cam 6. Cam 6 is linked mechanically to knob 3 and also the timer mechanism. Main contacts 5 are in the open position, as is shown in FIG. 2, when knob 3 is pointed at zero on time scale 4. In particular, contacts 5 are open because spring elbow 5*b* of contact 5*a* is lodged within cam recess 6. Main contacts 5 are in the closed position, as is shown in FIG. 3, when knob 3 is rotated clockwise to a countdown time greater than zero. Contacts 5 are closed because spring elbow 5*b* is withdrawn from cam recess 6*a* so as to ride on elevated surface 6*b* of cam 6.

When knob 3 returns to zero time after having been set to a countdown time greater than zero and main switch contacts 5 are opened (FIG. 2), the alarm and reset circuitry of the invention (FIG. 4), initiates a visual alarm by pulsing LED light 7 (FIG. 1) and an audible alarm by pulsing a horn 8 (FIG. 4) located within the housing of timer 1. LED 7 and horn 8 continue their alarm signaling functions until manual reset switch 9 (FIGS. 1 and 4) is manually closed for a momentary period.

In order to initiate another countdown timing operation it is only necessary to rotate knob 3 clockwise to the desired countdown time on time scale 4, thereby again closing contacts 5.

It should be noted in connection with the detailed explanation of the circuit of FIG. 4 that timer 1 has no on-off switch as such; however, circuit current during standby operation is negligible because all digital gates have high impedance inputs and the transistor amplifier is biased to cut-off. Accordingly, the batteries, which may be typically D-cells, have a useful life in excess of a year.

Figures 5, 6:
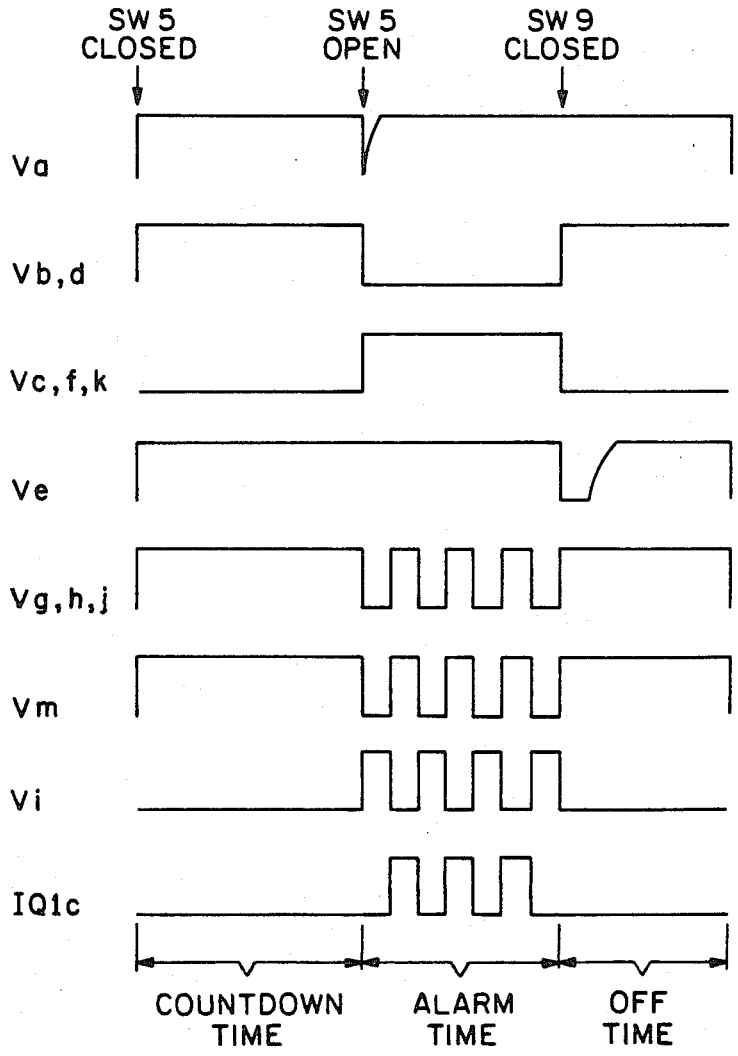
FIG. 5 is a conventional truth table using positive logic for the NAND gates employed in the circuit of FIG. 4.
FIG. 6 is a set of graphs showing the voltages and current at various points in the circuitry of FIG. 4 during the various steps of operation of the timer of FIG. 1 in performing its countdown function to zero time with a resulting alarm which is turned off by a momentary closing of the reset switch.

Referring to FIGS. 4 and 5 of the drawings, the principal circuit components are four NAND gates—NAND 1, NAND 2, NAND 3 and NAND 4, and transistor Q1 connected as a common-emitter amplifier. Input terminals g and h of NAND 4 are connected together and therefore this gate functions as an inverter only. The conventional truth table for the NAND gates is set forth in FIG. 5.

The key circuit functions will first be described out of time sequence in order to highlight the principal aspects of the circuit operation, namely, (1) the operation of NAND 3 as an oscillator to generate a series of pulses to activare LED 7 as a blinking visual alarm and horn 8 as a beeping audible alarm when main timer switch 5 opens at zero countdown time, and (2) thereafter ceasing the operation of NAND 3 as an oscillator in response to the momentary manual closure of reset switch 9.

NAND 3 is operated as an oscillator in response to a sustained inverting feedback voltage applied to input terminal m by R5–C5. In particular, immediately prior to oscillation, input terminals k and m to NAND 3 are low and high, respectively, causing output terminal j to be high; however, when main timer switch 5 is closed at countdown zero time, an extremely short low pulse is generated at terminal a of NAND 1 which causes input terminal k to go high and as a result output terminal j goes low. When output terminal j was high immediately prior to oscillation, C5 was charged to a high voltage which was applied to input terminal m; when output terminal j went low, however, C5 discharged through R5 causing a low voltage to be applied to input terminal m. This low at input terminal m, together with the high at input terminal k caused output terminal j to invert to a high. A sustained pulsing signal appears at output terminal j due to the repetitive high and low outputs charging and discharging C5 to apply an inverting input at terminal m. The period of the pulsing signal is determined by the time constant of R5–C5.

The pulsing output signal at terminal j is inverted by NAND 4 and thereafter amplified by transistor Q1 with the pulsating collector current causing LED 7 to emit a blinking light and horn 8 to beep intermittently.

LED 7 and horn 8 continue to render both visible and audible alarms at zero countdown time until manual reset switch 9 is momentarily closed. With this switch operation, input terminal e to NAND 2 is brought to a momentary low by the large C3 charging current passing through R4. As a consequence, output terminal d goes high because of the high existing at input terminal f. The high at output terminal d is applied directly to input terminal b for NAND 1. The high at input terminal b causes output terminal c to go low in view of the fact that input terminal a is at a high.

Input terminal k to NAND 3 goes low because of its direct connection to output terminal c. This low at terminal k, prevents the voltage across C5 from being an inverting feedback voltage which will maintain NAND 3 in an oscillatory condition. Accordingly, the alarms rendered by LED 7 and horn 8 cease in response to the momentary closure of reset switch 9.

The detailed operation of the circuit of FIG. 4 in precise time sequence, with descriprive reference to the set of eight voltage and current graphs of FIG. 6, is now set forth.

Initially knob 3 is manually rotated clockwise to the desired countdown time in the available time range, for example, from 60 minutes to a small increment somewhat above zero. The rotation of knob 3 closes main time switch contacts 5 (FIG. 3). Throughout the entire countdown time period (FIG. 6), the voltages at terminals a, b, d, e, g, h, j and m are at a high; and the voltages at terminals c, f, k and i are at a low. Additionally, no collector current is drawn by transistor Q1 because it is biased to cut-off.

When countdown zero time is attained, main time switch contacts 5 open (FIG. 2), and input terminal a for NAND 1 goes low for a relatively short period (see FIG. 6, curve Va). In particular, immediately prior to the opening of contacts 5, the voltage across C2 is zero volts because both plates of C2 are at Vcc (typically about 6 volts positive). When contacts 5 open, C2 starts charging producing a momentary large low-going voltage drop across R2 which is a 1 megohm resistor. As C2 completes charging to Vcc potential, terminal a goes high because the voltage drop across R2 goes to zero.

The momentary low at terminal a, changes output terminal c for NAND 2 to a high. Since input terminal f for NAND 2 is direcrly connected to terminal c, terminal f also goes high. Because there is no capacitor charging current flowing through R4 at this time, input terminal e for NAND 2 is at a high. The highs at both input terminals for NAND 2, alter output terminal d for NAND 2 to a low. This low also appears at input terminal b for NAND 1 because of the direct connection.

The momentary low at input terminal a and the low at input terminal b for NAND 2, causes output terminal c to go high as previously stated. Terminal c stays high, after terminal a goes high, however, because the high at terminal a combined with a low at terminal b, maintains the high at output terminal c.

The high at output terminal c is applied to input terminal k for NAND 3. Input terminal m for NAND 3 was previously at a high, due to the fact that output terminal j for NAND 3 was at a high, thereby charging C5 to the terminal j high through R5.

The highs at both input terminals for NAND 3 cause output terminal j for NAND 3 to go low (FIG. 6, curve Vg, h, j). The low at terminal j, causes fully charged C5 Co discharge through R5, thereby developing an inverting low at input terminal m, causing NAND 3 to go into an oscillatory condition due to the feedback voltage developed across C5 through R5 (see FIG. 6, curve Vg, h, j). In the main, the time constant for R5–C5 determines the frequency of oscillation, which in a preferred commercial embodiment is about 1.67 pulses per second.

The oscillarory output signal at terminal j is applied to input terminal g and h for NAND 4. Because NAND 4 is connected as an inverter, an inverted oscillatory signal appears at output terminal i for NAND 4 (see FIG. 6, curve Vi).

The oscillatory output signal at terminal i is applied to the base of common-emitter amplifier Q1 through resistor R6. Q1 is biased so that the low pulses applied to the base, cause collector current to flow in pulses (see FIG. 6, curve IQ1c). The collector current pulses flow through LED limiting resistor R7 and LED 7 and also alarm 8. Current flow through LED 7 and alarm 8 causes LED 7 to emit a visual alarm of blinking light and horn 8 an audible alarm of beeping sound.

The visual and audible alarms continue until reset switch 9 (FIGS. 1 and 4) is momentarily closed manually. When switch 9 is closed, C3 is grounded and the charging current for C3 produces a large voltage drop across R4 which produces a momentary low at input terminal e for NAND 2 (see FIG. 6, curve Ve). The low at terminal e produces a low at input terminal k for NAND 3 (see FIG. 6, curve Vc, f, k) which causes NAND 3 to stop oscillating thereby turning Q1 off. When Q1 is turned off, LED 7 and alarm 8 are deenergized. In particular, the momentary low at terminal e produces a high at Output terminal d. The highs at both input terminals a and b produce a low at output terminal c for NAND 1 which is applied directly to input terminal k to remove NAND 3 from an oscillatory condition.

Capacitors C1 and C4 produce arc suppression for switches 5 and 9, respectively; and resistors R1 and R3 isolate these capacitors from battery potential.

In a preferred embodiment, the resistors and capacitors of the circuit of FIG. 4 have the following values: R1 and R2 each 10,000 ohms; R2, R3, R4 and R5 each 1 megohm; R7, 470 ohms; C1 and C4 each 0.1 microfarads; C2 and C3 each 0.33 microfarads; and C5 2.2 microfarads.

Each of the NAND gates must have a very high impedance input so that negligible standby current is drawn. This is necessary because the circuit of FIG. 4 has no on-off switch to disconnect the typical six-volt battery source.

It should be understood that the above described structural features are merely illustrative of the principles of this invention and that modificarions can be made without departing from the scope of the invention.

What is claimed is:

1. In a battery-powered alarm and reset circuit for an electromechanical countdown timing mechanism which drives a set of cam-actuated main contacts to render both a visual alarm and an audible alarm at zero countdown time, the improvement comprising a digital logic circuit to which battery voltage is continuously applied during timer standby conditions including a digital gate having an output to input feedback circuit which places the digital gate into an oscillatory state to generate a low-frequency pulsing output signal which activates both the visual alarm and the audible alarm, means including the cam-actuated main contacts in a predetermined circuit condition for applying a first set of input voltages to the input of the digital gate which places the digital gate into an oscillatory condition to activate both alarms, and a reset circuit including a reset switch which closes and remains closed only during the application of a momentary manual closing force which applies a second set of input voltages to the input of said digital gate which removes the digital gate from its oscillatory state to thereby terminate both alarms and return the digital logic circuit to timer standby conditions.

2. The combination of claim 1 in which the cam-actuated main contacts are open in the predetermined circuit condition.

3. The combination of claim 1 in which battery voltage is continuously applied during standby, countdown, and alarm time condition.

4. The combination of claim 1 in which the digital gate is a NAND gate, the feedback circuit is an R-C circuit, the first set of input voltages is a periodic pair of highs applied to two separate input terminals followed by a pair including a high and a low applied to the two input terminals to thereby place the NAND gate into an oscillatory condition.

5. The combination of claim 4 in which the second set of input voltages is a non-periodic pair including a high and a low applied to the pair of input terminals opposite to the application of the high and low pair in the first set of voltages.

6. The combination of claim 5 in which the reset circuit includes a pair of NAND gates whose input voltage states are altered in response to the momentary closure of the reset switch.

7. The combination of claim 6 in which the visible alarm is a light-emitting diode and the audible alarm is a current-conducting horn.

* * * * *